United States Patent [19]

Glickman

[11] 4,083,069

[45] Apr. 11, 1978

[54] REVERSIBLE DUAL PURPOSE BOX SPRING

[76] Inventor: Manuel Glickman, 1500 Worcester Rd., Framingham, Mass. 01701

[21] Appl. No.: 752,121

[22] Filed: Dec. 22, 1976

[51] Int. Cl.[2] ..... A47C 27/08; A47C 27/22

[52] U.S. Cl. ..... 5/345 R; 5/355; 5/361 R; 5/351

[58] Field of Search ..... 5/327, 345, 354, 351, 5/DIG. 2, 361 R, 361 B

[56] References Cited

U.S. PATENT DOCUMENTS

| | | | |
|---|---|---|---|
| 2,471,125 | 5/1949 | Sohn et al. | 5/DIG. 2 |
| 3,138,806 | 6/1964 | Goodman et al. | 5/345 |
| 3,534,417 | 10/1970 | Boyles | 5/345 R |
| 3,846,857 | 11/1974 | Weinstock | 5/DIG. 2 |

*Primary Examiner*—Casmir A. Nunberg

[57] ABSTRACT

An improved box spring construction that provides two mattress supporting surfaces, each of which are of different firmness so as to eliminate the need for mattress stiffening bed boards, and to materially increase the desirability, life and usefulness of the box spring.

2 Claims, 3 Drawing Figures

FIG.1
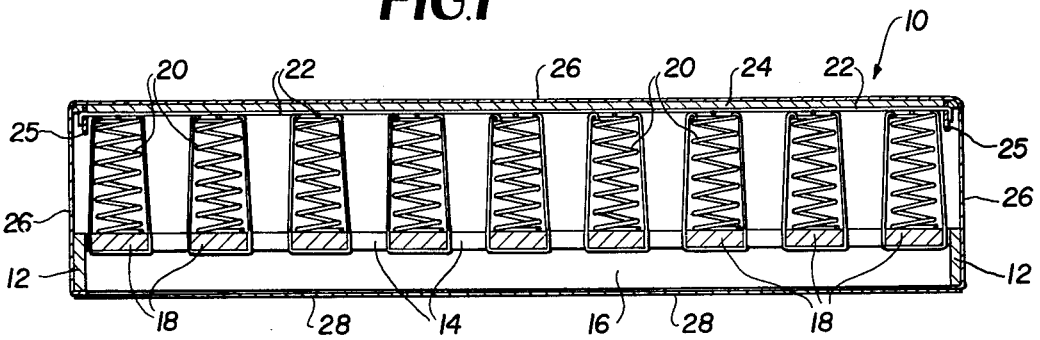
FIG.2
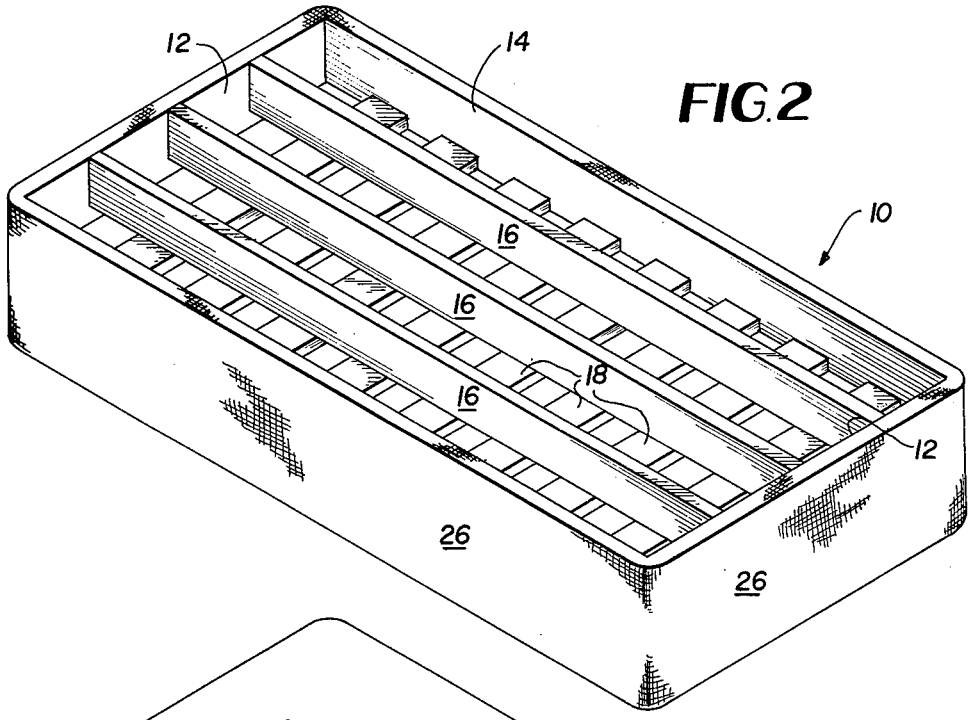
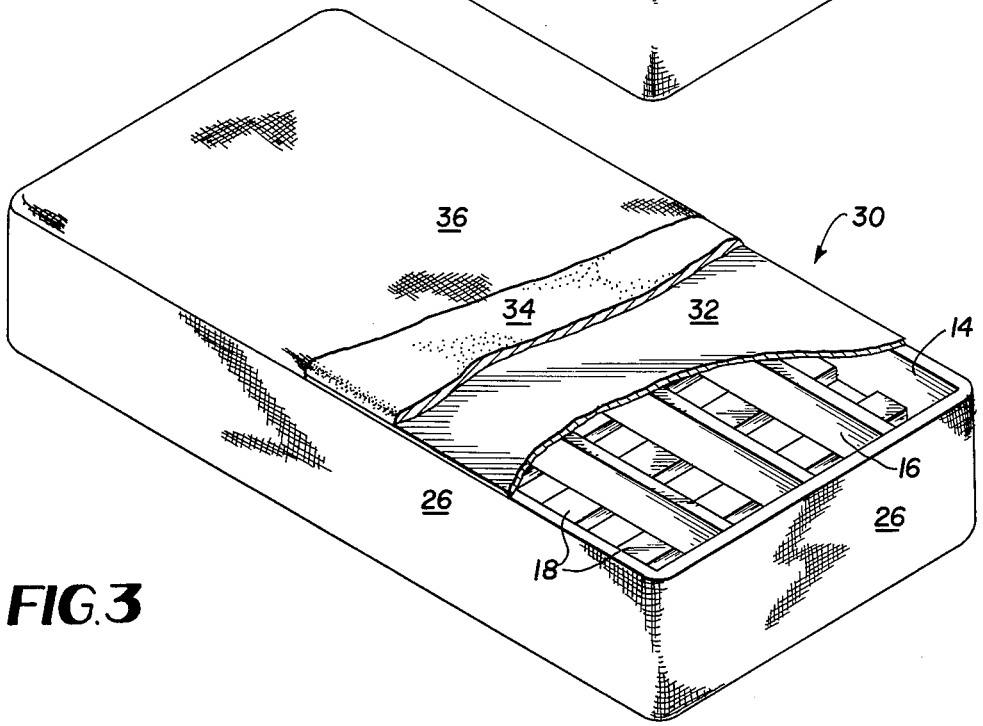
FIG.3

REVERSIBLE DUAL PURPOSE BOX SPRING

This invention relates generally to mattress supporting means and more particularly to an improved box spring construction.

Box springs are well known in the art and usually comprise rigid side and end frame members of a given height having spaced, longitudinally extending vertical slats which support spaced, laterally extending horizontally disposed slats, which in turn support a plurality of longitudinally and laterally spaced compression-type coil springs. The springs are fixed to the horizontal slats at their bases and at their tops to longitudinally and laterally extending wires or large mesh screen fixed to the sides and ends of the box spring frame which is rigidly supported on a peripheral bed frame.

Such prior art box spring constructions provide a single resilient and cushioning supporting surface for mattresses and leave much to be desired for people with back problems, etc. and the usual solution is to buy a much firmer mattress or a bed board which is placed between the mattress and the box springs. Such solutions are expensive and quite often unsatisfactory and fail to provide the degree of firmness desired.

Accordingly, the main object of the present inventions to provide an improved box spring construction which will obviate the objectional solutions provided by prior art structures.

An important object of the present invention is to provide an improved box spring construction which has two mattress supporting surfaces, each coextensive with the mattress to be supported.

Another important object of the present invention is to provide a box spring construction having two mattress supporting surfaces of different firmness so as to be reversible and vary the rigidity of the mattress itself.

A further important object of the present invention is to provide a box spring construction having two mattress supporting surfaces of different firmness whereby the firmer of the two surfaces will eliminate the need for a bed board by the user of the supported mattress.

Other objects and advantages of the present invention will become apparent during the course of the following description.

In the drawings, I have shown one embodiment of the present invention, In this showing:

FIG. 1 is a central longitudinal vertical sectional view of a conventional box spring;

FIG. 2 is a perspective bottom view thereof; and

FIG. 3 is a similar but broken-away view showing the present invention.

Referring now to the drawings, numeral 10 designates one of a number of conventional box spring constructions which, in the present instance, is shown as comprising a pair of end rails 12 between which a pair of longitudinally extending side rails 14 and a plurality of spaced intermediate rails 16 are disposed.

The rails 14 and 16 are fixed to the end rails 12 and are vertically disposed to support a plurality of spaced horizontally disposed and transversely extending slats 18 which are fixed to the side rails 14. As seen in FIG. 1, a plurality of longitudinally and laterally spaced, compression type coil springs 20 are mounted on the slats 18 and secured by suitable means. The upper ends of the springs are secured to each other and thus retained in their relative positions by longitudinally or transversely extending wires or by a large mesh rectangular screen 22 whose peripheral edges are secured to edge strips 25 which are usually of suitable metal.

Thus, when the edge of the box spring or any part of it is depressed, the force is distributed to a plurality of adjacent springs and an edge strip. The top surface of the screen 22 etc. is provided with a layer 24 of padding covered by ticking 26 which extends downwardly over and is secured to the sides and ends of the box spring 10. If desired, it may also extend over the bottom also as at 28 to conceal the unfinished wood forming the rails and slats but, of course, is non load bearing.

The present invention, as shown in FIG. 3, includes important additions to a conventional box spring so as to comprise a highly useful and versatile box spring structural combination. A box spring construction 30 of the nature earlier described, is placed in an inverted position and any ticking 28 is removed from that side. A thin sheet 32 of rigid material such as masonite, plywood, etc. which is coextensive with the box spring construction is now securely mounted on the side and end rails 14 and 12 and of course, on the intermediate rails 16.

This bottom closure 32 is now provided with one or more layers of urethane, cotton batting or other mattress filling 34 which is anchored wth ticking 36 at its peripheral edges. Thus, the now completed box spring construction now comprises a dual reversible foundation for mattresses which may be placed on either of the box springs resilient or padded rigid surfaces. While the ticking 36 may be identical to the ticking 26 in color or design, it is preferable that there be a difference so that the firm side of the dual reversible box spring construction may be readily detected.

It will now be readily apparent that the present invention provides two supporting surfaces for mattresses, a choice of two different degrees of firmness of support for the mattress, a rigidity in one of the mattress supportng surfaces that obviates the need for bed boards or other substitutes therefor, and a great increase in the life and years of usefulness of the structure.

It is to be understood that the form of my invention herewith shown and described is to be taken as a preferred example of the same and that various changes in the shape, size and arrangement of parts may be resorted to without departure from the spirit of the invention or the scope of the subjoined claims.

What is claimed is:

1. A box spring for resiliently and rigidly supporting a mattress comprising a rigid box-like structure adapted to be supported at its peripheral edges only by a bedstead frame; said structure having upper and lower load bearing surfaces coextensive with that of a mattress to be supported; one of said surfaces being resiliently supported by means mounted in said structure and the other of said surfaces having a rigid support so that the reversing of said surfaces varies the firmness of the supported mattress.

2. The combination recited in claim 1; and means for indicating which of said surfaces is which.

* * * * *